US006612293B2

(12) United States Patent
Schweinzer et al.

(10) Patent No.: US 6,612,293 B2
(45) Date of Patent: Sep. 2, 2003

(54) EXHAUST GAS RECIRCULATION COOLER

(75) Inventors: Franz Schweinzer, Graz (AT); Marko Vide, Graz (AT); Jan Marek, Reichertshausen (DE)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/198,088

(22) Filed: Jul. 19, 2002

(65) Prior Publication Data

US 2003/0037774 A1 Feb. 27, 2003

(30) Foreign Application Priority Data

Jul. 23, 2001 (AT) ..... 583/01 U

(51) Int. Cl.[7] ..... F02M 25/07

(52) U.S. Cl. ..... 123/568.12; 165/104.14; 165/104.28

(58) Field of Search ..... 123/568.12, 567.11; 165/104.28, 104.14, 154, 66

(56) References Cited

U.S. PATENT DOCUMENTS

| | | | | |
|---|---|---|---|---|
| 3,662,542 A | | 5/1972 | Streb | 60/320 |
| 3,737,286 A | | 6/1973 | Kofink | 422/175 |
| 3,962,869 A | | 6/1976 | Wössner | 60/298 |
| 4,107,922 A | | 8/1978 | Wössner | 60/298 |
| 4,537,247 A | * | 8/1985 | Okamoto et al. | 165/104.14 |

FOREIGN PATENT DOCUMENTS

| | | |
|---|---|---|
| AT | 003888 | 9/2000 |
| DE | 4319380 | 12/1993 |
| RU | 2070655 | 3/1994 |

* cited by examiner

*Primary Examiner*—Henry C. Yuen
*Assistant Examiner*—Arnold Castro
(74) *Attorney, Agent, or Firm*—Dykema Gossett PLLC

(57) ABSTRACT

An exhaust gas recirculation cooler (EGR cooler) provided in an exhaust gas recirculation line departing from an exhaust system and opening into an intake system of an internal combustion engine is configured as a heat pipe heat exchanger including at least one enclosed and evacuated heat pipe filled with a working medium, the first end of the heat pipe being subject to exhaust gas from the exhaust gas recirculation line and the second end being in contact with a heat sink. In order to provide a compact design which will permit simple and effective cooling of the recycled exhaust gas, the longitudinal axis of the EGR cooler is aligned in parallel with the axis of the at least one heat pipe, so that an essentially axial flow of exhaust gas is obtained in the EGR cooler.

15 Claims, 2 Drawing Sheets

EXHAUST GAS RECIRCULATION COOLER

BACKGROUND OF THE INVENTION

The present invention relates to an exhaust gas recirculation cooler, which is provided in an exhaust gas recirculation line departing from an exhaust system and opening into an intake system of an internal combustion engine, and is configured as a heat pipe heat exchanger including at least one enclosed and evacuated heat pipe filled with a working medium, the first end of said heat pipe being subject to exhaust gas from the exhaust gas recirculation line and the second end being in contact with a heat sink.

DESCRIPTION OF PRIOR ART

In order to obtain lower NOx emissions in internal combustion engines it is known in the art to recirculate part of the exhaust gas stream from the exhaust system into the intake system. The NOx emissions are reduced directly upon combustion, by reducing both flame temperature and combustion rate. These mechanisms will lower combustion gas temperature during the combustion process despite the fact that the temperature of the intake air/exhaust gas mixture is increased by recirculating the exhaust gas. For a further decrease in NOx emissions it has proved of advantage if the two components of the admitted mixture (fresh air and recirculated exhaust gas) are additionally cooled off as far as possible. An internal combustion engine of this type is disclosed in DE 43 19 380 A1, for example. The EGR cooler usually is configured as a simple air/air or air/water heat exchanger whose working medium will not change its physical state.

U.S. Pat. No. 3,962,869 A and U.S. Pat. No. 4,107,922 A describe an internal combustion engine where a heat exchanger based on the heat pipe principle is provided in the exhaust system for the transfer of heat from the exhaust manifold to an exhaust gas reactor.

Another internal combustion engine with a heat pipe heat exchanger is disclosed in RU 2 070 655 C1, wherein heat is withdrawn from the exhaust gas of the exhaust system and transferred to a carburetor of the intake system.

U.S. Pat. No. 3,662,542 A describes an exhaust gas heating unit where energy is removed from the hot stream of exhaust gas of an engine and used for heating the passenger compartment on the principle of heat exchange. This unit is not provided in an exhaust gas recirculation line but in the engine's exhaust system.

A heat pipe concentric with the exhaust pipe of an internal combustion engine is described in U.S. Pat. No. 3,737,286 A, though it is not provided for exhaust cooling but for after-burning of the exhaust gases by the addition of fresh air.

Heat exchangers operating on the principle of heat pipes are provided with one or more enclosed and evacuated pipes. Each pipe forms a closed circuit. Heat transport is effected by circulation of a special working medium in the pipe. By continuous evaporation and subsequent condensation of the evaporable working medium, such as methanol, the heat admitted at one end of the pipe is carried off to a heat sink at the other end of the pipe due to condensation of the working medium.

An exhaust gas recirculation cooler configured as heat pipe heat exchanger with at least one enclosed and evacuated heat pipe filled with a working medium, whose one end is disposed in the exhaust gas recirculation line and whose other end is connected to a heat sink, has been published in AT-GM 3.888. The first end of each heat pipe in the exhaust gas recirculation line is subject to the recycled exhaust, the flow direction of the exhaust gas being essentially normal to the axis of each heat pipe (transverse flow). The second end connected to a heat sink is subject to the gaseous or liquid cooling medium. The heat sink may be formed by the engine cooling system or the heating system for the passenger compartment.

SUMMARY OF THE INVENTION

It is the object of the present invention to further improve an exhaust gas recirculation cooler of the above type by keeping the number of pipes small whilst maintaining full performance, such that a lighter, simpler design requiring less space will be obtained.

According to the invention this object is achieved by providing that the longitudinal axis of the exhaust gas recirculation cooler, to be called EGR cooler henceforth, be aligned in parallel with the axis of the at least one heat pipe, so that an essentially axial flow of exhaust gas will be obtained in the EGR cooler. The longitudinal flow will result in a very compact design, improving cooling performance and reducing pressure losses.

Particularly efficient cooling of the recycled exhaust will be obtained by using a pipe-shaped design for the housing of the EGR cooler and dividing it by a supporting plate, so that a first compartment subject to the exhaust gas and a second compartment subject to a cooling medium is obtained, the supporting plate holding a bundle of heat pipes whose first ends project into the compartment subject to the exhaust gas and whose second ends project into the compartment subject to the cooling medium.

According to the invention the heat pipes are disposed in at least one concentric circle around a central heat pipe, the compartment of the EGR cooler subject to the exhaust gas being provided with an essentially axial exhaust inlet opening on one end and an essentially radial exhaust outlet opening on the opposite end. In a preferred arrangement one central heat pipe is surrounded by six concentrically disposed heat pipes. In order to improve uniform flow along the individual heat pipes a diffuser may be provided which departs from the exhaust inlet opening and expands in width towards the heat pipes, the central heat pipe projecting beyond the other heat pipes and extending into the region of the diffuser.

It is provided in a particularly preferred variant of the invention that the compartment of the EGR cooler subject to the exhaust gas be provided with two concentically disposed pipes in the vicinity of the exhaust outlet opening, which form a toroidal space, the inner pipe adjacent to the diffuser forming a gap-shaped opening together with the supporting plate. The stream of exhaust gas thus passes along the individual heat pipes before entering the toroidal space in the region of the supporting plate, which space contains the exhaust outlet opening. In this way short-circuiting of the exhaust stream from inlet to outlet opening and an uneven flow past the individual heat pipes is prevented. It will be of special advantage in this context if the width of the gap-shaped opening is non-uniform, the smallest width of the gap being provided next to the exhaust outlet opening. On the side of the outlet opening the inner pipe may extend up to the supporting plate.

Depending on a potential temperature gradient in the EGR cooler the heat pipe diameters and/or depths to which the heat pipes are immersed into the recycled exhaust and/or heat sink may vary. Within one and the same EGR cooler the type of working medium and/or filling level may differ between at least two of the heat pipes.

BRIEF DESCRIPTION OF THE DRAWINGS

Following is a more detailed description of the invention with reference to the accompanying drawings, in which.

Parts of identical function have identical reference numerals in all drawings.

DETAILED DESCRIPTION OF THE PREFERRED EMBODIMENT

Figure 1:
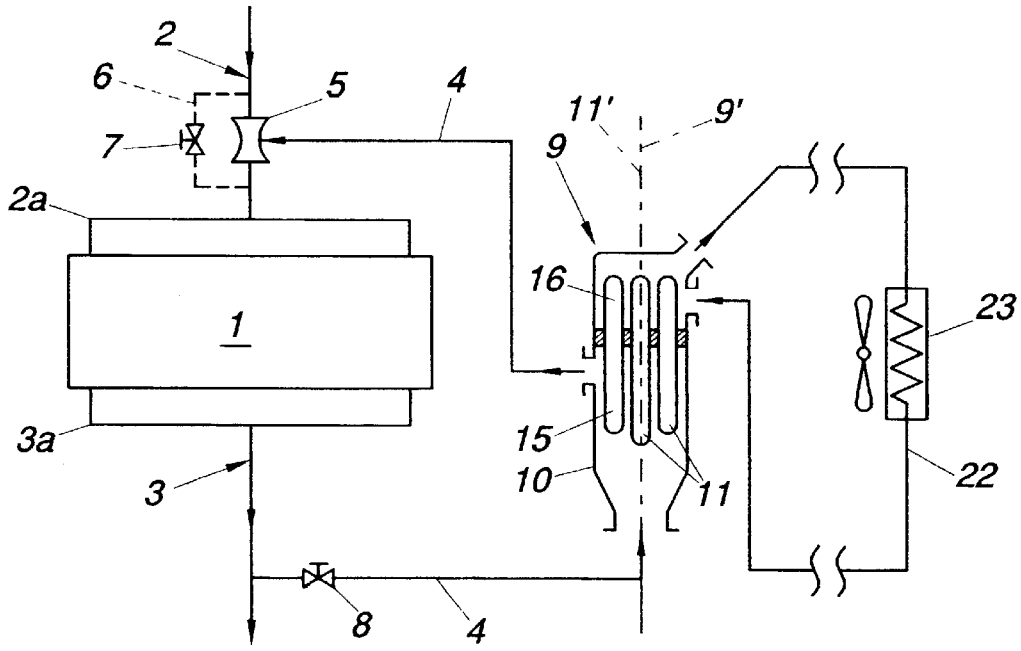
FIG. 1 is a schematical drawing of an internal combustion engine featuring an EGR cooler according to the invention.

The internal combustion engine 1 represented schematically in FIG. 1 has an intake system 2 and an exhaust system 3. Numeral 2*a* refers to an intake manifold of the intake system 2, while 3*a* refers to an exhaust manifold of the exhaust system 3. For exhaust gas recirculation an exhaust gas recirculation line 4 branches off from the exhaust system 3 and opens into the intake system 2, where a nozzle-diffuser unit 5 may be provided in the entry area. The nozzle-diffuser unit 5 may be bypassed via a bypass-line 6 in which a control valve 7 is provided.

To control the amount of recycled exhaust gas an exhaust recycling control valve 8 is provided in the exhaust gas recirculation line 4. In this exhaust gas recirculation line 4 the EGR cooler 9 proposed by the invention is provided (details see FIG. 2), by which the temperature of the recycled exhaust gas and thus the temperature of the combustion chamber may be further reduced in order to obtain lower NOx emissions. The EGR cooler 9 is configured as a heat pipe heat exchanger working on the principle of heat pipe systems known in the art. The heat pipe heat exchanger comprises a number of enclosed heat pipes 11 whose interior is evacuated and contains an evaporable working medium, such as alcohol, water, etc. The housing 10 of the EGR cooler 9 is pipe-shaped, and is divided by a supporting plate 12 into a first compartment 13 subject to exhaust gas and a second compartment 14 subject to a cooling medium 14. The supporting plate 12 carries a bundle of heat pipes 11 whose first ends 15 extend into compartment 13 of the EGR cooler 9 subject to exhaust gas and whose second ends 16 extend into compartment 14 subject to the cooling medium. If a cooling fluid is used, the second ends 16 may be disposed in a closed cooling channel of a cooling circuit 22, which could be an engine cooling system or a heating system for the passenger compartment. Numeral 23 refers to a heat exchanger for carrying off the heat of the cooling circuit 22, such as the radiator or a heater-radiator.

Figure 2:
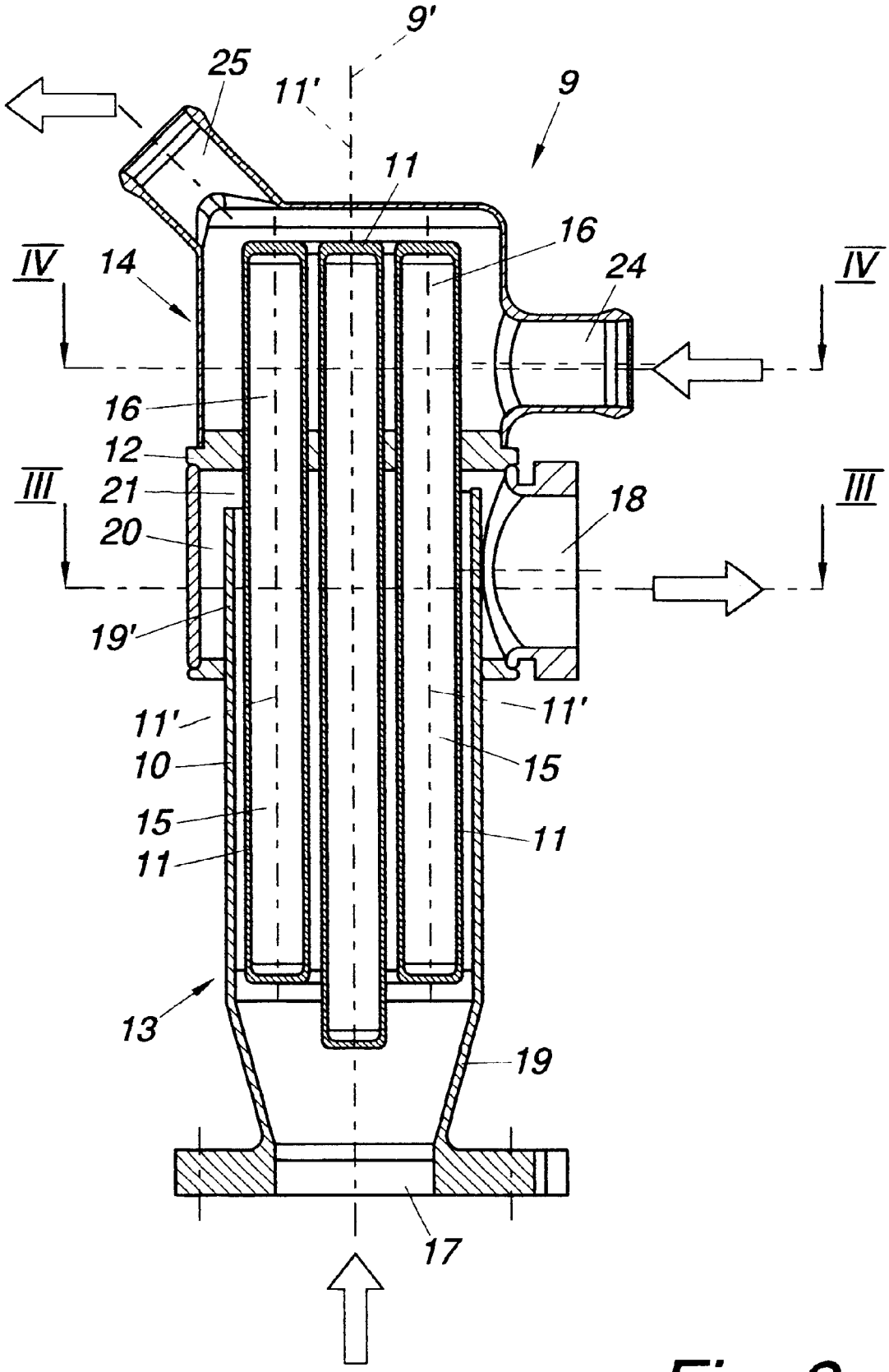
FIG. 2 presents a longitudinal section of the EGR cooler.

To improve the flow of the exhaust gas and increase overall efficiency, the longitudinal axis 9' of the EGR cooler 9 is aligned parallel to the axes 11' of the heat pipes 11, providing for an essentially axial flow of the exhaust stream in the EGR cooler 9 (FIG. 2). A diffuser 19 is provided, which departs from the exhaust inlet opening 17 and increases in width towards the heat pipes 11. Compartment 13 of the EGR cooler 9, which is subject to the exhaust gas, has two concentrically arranged pipes forming a toroidal space 20 in the area of the exhaust outlet opening 18, the inner pipe 19' adjoining the diffuser 19 forming a gap-shaped opening 21 together with the supporting plate 12, through which the exhaust gas enters the toroidal space 20. In order to avoid any direct connection between exhaust inlet and outlet openings, the width of the gap 21, i.e., the distance between the rim of the inner pipe 19' and the supporting plate 12, being smallest next to the exhaust outlet opening 18.

Compartment 14 of the EGR cooler 9, which is subject to the coolant, has an inlet opening 24 and an outlet opening 25 for the entry and exit of cooling water.

Figure 3:
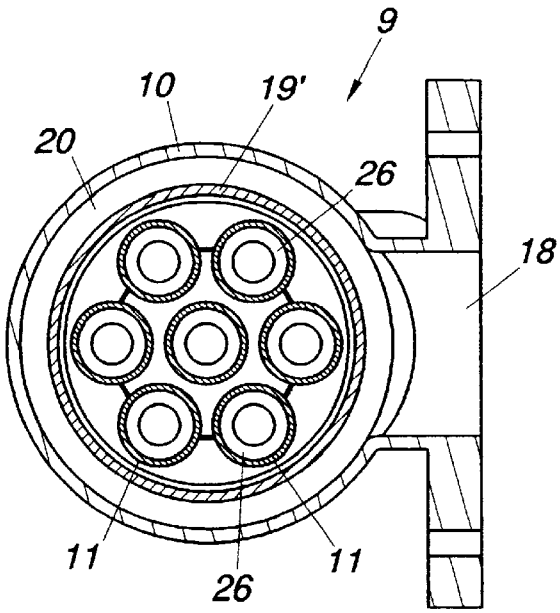
FIGS. 3 and 4 present radial sections of the EGR cooler along lines III—III and IV—IV in FIG. 2.

FIG. 3 presents a section at the height of the axis of the exhaust outlet opening 18 through which the spent gas is discharged from the toroidal space 20.

Figure 4:
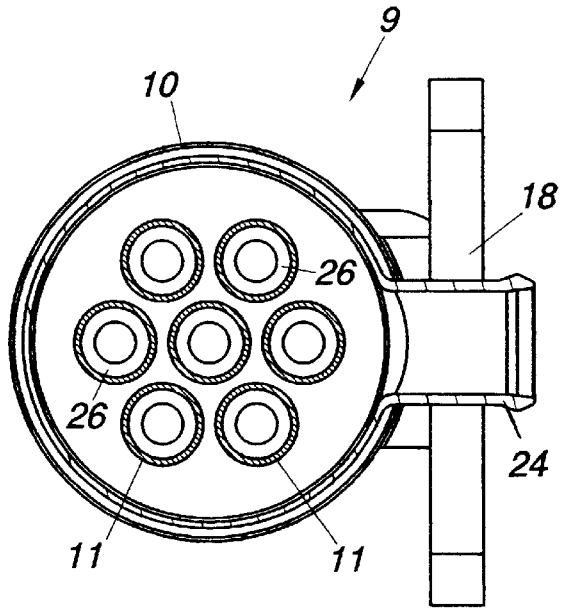

FIG. 4 presents a section at the height of the coolant inlet opening 24, showing the ends of the heat pipes 11 immersed into the coolant.

The exhaust gas admitted into compartment 13 of the EGR cooler 9 will heat the first ends 15 of the heat pipes 11 and thus the working medium contained therein, inducing it to evaporate and withdraw heat from the exhaust gas. The second ends 16 are cooled by the coolant contained in compartment 14, which will induce the vaporized working medium to condense at the second ends 16 and deliver heat to the coolant. The condensed working medium travels downwards along the interior surface of the heat pipes 11 to the first ends 15 of the heat pipes. This "free" circulation of the working medium may be transformed into a kind of "forced" circulation by adding a capillary body 26 (FIGS. 3 and 4) extending along the entire inner length of the heat pipe. The capillary body 26, which preferably consists of several layers of wire mesh or porous metal sponge, will improve both transport of the condensed working medium to the heat source and evaporation conditions.

The heat pipes 11 are preferably arranged in at least one concentric circle (see FIGS. 3 and 4) around a central heat pipe 11.

The exhaust gas recirculation cooler proposed by the invention will permit simple and effective cooling of the recycled exhaust gas and is characterized by a most compact design in combination with high efficiency, short response times and a very low flow resistance.

What is claimed is:

1. EGR cooler having a longitudinal axis and being provided in an exhaust gas recirculation line departing from an exhaust system and opening into an intake system of an internal combustion engine, and being configured as a heat pipe heat exchanger including at least one enclosed and evacuated heat pipe filled with a working medium and $N having a longitudinal axis, a first end of said heat pipe being subject to exhaust gas from said exhaust gas recirculation line and a second end being in contact with a heat sink, wherein said longitudinal axis of said exhaust gas recirculation cooler is aligned in parallel with said longitudinal axis of said at least one heat pipe, so that an essentially axial flow of exhaust gas is obtained in said EGR cooler.

2. EGR cooler according to claim 1, wherein a housing of said EGR cooler is pipe-shaped and is divided by a supporting plate into a first compartment subject to said exhaust gas and a second compartment subject to a cooling medium, said supporting plate holding a bundle of said heat pipes whose first ends project into said compartment subject to said exhaust gas and whose second ends project into said compartment subject to said cooling medium.

3. EGR cooler according to claim 2, wherein said compartment subject to said exhaust gas is provided with two concentrically disposed pipes in the vicinity of said exhaust outlet opening, which form a toroidal space, the inner of said two pipes adjacent to said diffuser forming a gap-shaped opening together with said supporting plate.

4. EGR cooler according to claim 3, wherein the width of said gap-shaped opening is non-uniform, the smallest gap width being provided next to said exhaust outlet opening.

5. EGR cooler according to claim 1, wherein a plurality of said heat pipes is disposed in at least one concentric circle around a central heat pipe.

6. EGR cooler according to claim 5, wherein said compartment subject to said exhaust gas is provided with an essentially axial exhaust inlet opening on one end and an essentially radial exhaust outlet opening on the opposite end.

7. EGR cooler according to claim 6, wherein a diffuser is provided which departs from said exhaust inlet opening and expands in width towards said heat pipes.

8. EGR cooler according to claim 7, wherein said central heat pipe projects beyond all other heat pipes and extends into said diffuser.

9. EGR cooler according to claim 1, wherein said heat sink is formed by a liquid coolant.

10. EGR cooler according to claim 9, wherein said liquid coolant is cooling water of an engine cooling system.

11. EGR cooler according to claim 1, wherein the diameters of said heat pipes are different.

12. EGR cooler according to claim 1, wherein the depths to which said heat pipes are immersed into said recycled exhaust are different.

13. EGR cooler according to claim 1, wherein the depths to which said heat pipes are immersed into said heat sink are different.

14. EGR cooler according to claim 1, wherein at least two of said heat pipes contain different types of working medium, depending on a temperature gradient in said EGR cooler.

15. EGR cooler according to claim 1, wherein filling levels of said working medium are different in at least two -of said heat pipes, depending on a temperature gradient in said EGR cooler.

* * * * *